US006443319B1

(12) United States Patent
Sander

(10) Patent No.: US 6,443,319 B1
(45) Date of Patent: Sep. 3, 2002

(54) SHELF SYSTEM

(76) Inventor: Julian Sander, Burbacher Strasse 58 D-53129, Bonn (DE)

( * ) Notice: Subject to any disclaimer, the term of this patent is extended or adjusted under 35 U.S.C. 154(b) by 0 days.

(21) Appl. No.: 09/242,437

(22) PCT Filed: Aug. 5, 1997

(86) PCT No.: PCT/EP97/04247

§ 371 (c)(1),
(2), (4) Date: Dec. 30, 1999

(87) PCT Pub. No.: WO98/07351

PCT Pub. Date: Feb. 26, 1998

(30) Foreign Application Priority Data

Aug. 17, 1996 (DE) ..... 296 14 265 U

(51) Int. Cl.[7] ..... A47B 5/00

(52) U.S. Cl. ..... 211/187; 211/186; 108/106

(58) Field of Search ..... 211/187, 186, 211/86.01; 108/109, 152, 106, 107

(56) References Cited

U.S. PATENT DOCUMENTS

| | | | | | |
|---|---|---|---|---|---|
| 914,572 | A | * | 3/1909 | Holden | 248/243 |
| 1,382,505 | A | * | 6/1921 | Hargey | 211/80.6 |
| 1,561,432 | A | * | 11/1925 | Hitchcock | 248/230.2 |
| 2,903,227 | A | * | 9/1959 | De Kalb Key | 248/356 |
| 2,912,205 | A | * | 11/1959 | Toune | 248/210 |
| 3,179,212 | A | * | 4/1965 | Gostling | 189/19 |
| 3,221,678 | A | * | 12/1965 | Doherty | 108/152 |
| 3,762,116 | A | * | 10/1973 | Anderson et al. | 52/239 |
| 3,771,466 | A | * | 11/1973 | Ferdinand et al. | 108/109 |
| 3,949,834 | A | * | 4/1976 | Nusbaum | 182/138 |
| 4,145,849 | A | * | 3/1979 | Shindoll et al. | 52/36 |
| 4,188,758 | A | * | 2/1980 | Swann | 52/241 |
| 4,222,541 | A | * | 9/1980 | Cillis | 248/210 |
| 4,345,398 | A | * | 8/1982 | Pickett | 42/94 |
| 4,368,997 | A | * | 1/1983 | Shemtow | 403/59 |
| 4,516,619 | A | * | 5/1985 | Hasbrouck | 160/135 |
| 4,603,781 | A | * | 8/1986 | Ryan, Jr. | 211/90 |
| 4,729,535 | A | * | 3/1988 | Frazier et al. | 248/230 |
| 4,776,550 | A | * | 10/1988 | Storey | 248/210 |
| 4,801,119 | A | * | 1/1989 | Pelletier | 248/354.5 |

(List continued on next page.)

FOREIGN PATENT DOCUMENTS

| | | |
|---|---|---|
| DE | 73 06 127 | 2/1974 |
| DE | 81 10 051.5 U1 | 4/1981 |
| FR | 480 614 A | 8/1916 |
| FR | 1 524 363 A | 9/1968 |
| FR | 2 623 064 A | 5/1989 |
| FR | 42 10 388 | 8/1992 |
| GB | 2 139 478 A | 11/1984 |

*Primary Examiner*—Daniel P. Stodola
*Assistant Examiner*—Khoa Tran
(74) *Attorney, Agent, or Firm*—Hutchins, Wheeler & Dittmar

(57) ABSTRACT

A shelf system has supporting rods (2) and shelf boards (3) provided with fastening devices for fastening them to the supporting rods (2) at various heights. The supporting rods are usually arranged in the comer areas of the rectangular shelf boards. Bores are pierced at certain heights in the supporting rods into which fastening elements such as supporting pegs can be plugged to hold the shelf boards at the corresponding height. The object of the invention is a novel shelf system which allows the height of the shelf boards to be continuously adjusted and in which the position of the shelf boards can be adjusted within a certain angular range. For that purpose, the supporting rods (2) are cylindrical and each shelf board (3) has in the middle of each of its face edges (4) a fastening device which consists of a pair of parallel clamping pins (5) which project beyond the respective face edge (4) and which are interconnected by a clamping screw (6) which pulls together both clamping pins (5), a supporting rod (2) being clamped between each pair of clamping pins.

18 Claims, 3 Drawing Sheets

U.S. PATENT DOCUMENTS 4,819,817 A * 4/1989 Mar ..... 211/205
4,824,302 A * 4/1989 Schultheis et al. ..... 410/151
4,981,397 A * 1/1991 Wiltse ..... 405/218
5,065,873 A * 11/1991 Tseng ..... 211/187
5,078,349 A * 1/1992 Smith ..... 248/125
5,095,862 A * 3/1992 Murphy ..... 123/90.61
5,148,928 A * 9/1992 Arnold ..... 211/187
5,274,970 A * 1/1994 Roberts ..... 52/126.2
5,281,063 A * 1/1994 Austin, III ..... 410/151
5,338,137 A * 8/1994 Jensen ..... 410/146
5,347,778 A * 9/1994 Bray ..... 52/239
5,381,738 A * 1/1995 Meyer ..... 108/42
5,558,501 A * 9/1996 Wang et al. ..... 416/244 R
5,660,432 A * 8/1997 Davis ..... 297/182
5,728,959 A * 3/1998 O'Rorke ..... 84/453
5,826,847 A * 10/1998 Warner et al. ..... 248/354.1
5,903,995 A * 5/1999 Brubach ..... 42/94
5,924,469 A * 7/1999 Whittemore ..... 160/368.1
6,021,720 A * 2/2000 Boos et al. ..... 108/44

* cited by examiner

SHELF SYSTEM

FIELD OF THE INVENTION

The invention relates to a shelf system with support rods and shelf boards which include fastening devices for fastening to the support rods at different heights.

BACKGROUND OF THE INVENTION

Typically, the support rods are combined to form support frames which are arranged in the right and left corner regions of the rectangular shelf boards. Holes are arranged at various heights on the support rods. Fastening elements, such as support pins, which hold the shelf boards at the different heights can be inserted into these holes.

The French Patent No. 480 614 describes a shelf system with shelf boards that do not include fastening devices. Instead, the shelf boards are placed on a transversely extending traverses which include at their respective ends a pair of curved gripping jaws that can be pressed together with screws. To support one shelf board, two traverses have to be placed between each pair of support rods. Consequently, each shelf board is supported by four rods extending in the respective corner regions of the shelf board. The shelf board is quite difficult to install since for each board two traverses have to be secured to two support rods with two clamps each and adjusted in height.

The French Patent No. 1 524 363 describes a shelf system wherein each shelf board has on each of its four corners, i.e., in the end regions of the respective opposite end faces, a fastening device with a pair of curved gripping jaws that can be pressed together with screws. This reference essentially discloses the preamble of claim 1. However, attaching the board is still complicated since four pairs of clamping surfaces have to be pushed onto four support rods and clamped on these support rods.

It is an object of the invention to provide a novel shelf system wherein the height of the shelf boards can be continuously adjusted and wherein the position of the shelf boards of adjacent shelf sections can be adjusted within a predetermined angular range.

SUMMARY OF THE INVENTION

The object is solved by the invention in that the support rods have the form of cylinders and that each shelf board includes a fastening device arranged in the center of the two end faces of the shelf board. The fastening device consists of a pair of parallel clamping rods which project from the end face. The clamping rods are connected to each other by a clamping screw which pulls the two clamping rods toward each other, wherein one support rod is clamped between each pair of clamping rods.

With this type of clamping system which does not include bores and support pins for attaching the shelf boards, the shelf boards can be clamped to the support rods at any height. Because the cylindrical support rods have a round cross-section, the shelf boards can radially extend from the support rods in any direction and be clamped to the support rods in any position.

With the shelf system of the invention, the shelves can be installed in many ways. For example, a central support rod can be provided from which several (for example, three or five) shelf sections extend radially outwardly, forming a star. Each shelf section is associated with an outer support rod to which the outside end faces of the shelf boards are clamped. It is also possible to provide long shelf units consisting of several consecutive sections, wherein the center axes of the shelf boards of consecutive shelf sections extend along an arbitrary polygonal path. This design of a shelf unit can be readily adapt to fit, for example, a curved building wall.

The inside surfaces of the clamping rods which contact the cylindrical support rod, should be as straight as possible, so that they can be easily pushed over the circumference of the support rod. In this way, a shelf board can be attached to or removed from an installed shelf at any position. This is more difficult when the gripping jaws are curved. It may be necessary to first release one clamping rod completely from the shelf board and to then reattach this clamping rod after the support rod has been inserted into the curved surface of the other clamping rod. Alternatively, the shelf board may be inserted from above by pushing the support rod into the opposing curved surfaces of the two clamping rods. Consequently, clamping rods with straight inside surfaces provide the simplest installation for the shelf board. The surface of the clamping rods which is oriented outwardly from the support rods, can have any shape.

Preferably, the clamping rods located on opposite end faces of the shelf boards are offset from each other by a distance corresponding to the height of the clamping rods. For example, the clamping rods disposed on the right end face of the shelf boards may be inserted in the upper half of the shelf board, whereas the clamping rods disposed on the left end face may be inserted in the lower half. Shelf boards of adjacently positioned shelf sections can thereby be arranged in the same plane. The clamping devices attached to the same support rod are offset from each other so as not to interfere with each other.

The clamping screw is advantageously arranged between the end faces of the shelf boards and the support rods. Positioning the clamping screw on the side of the support rods opposite from the end faces may make it difficult to arrange the shelf boards side-by-side in the same plane. In order to arrange the shelf boards side-by-side and at the same height, the free ends of the clamping rods projecting beyond the clamping screws are preferably shorter in length than the diameter of the support rods. The free ends then do not extend beyond the support rods and do not make contact with the adjacent shelf board. The free ends have to be at least as long as the radius of the support rods, so that the clamping rods can clamp the support rod along two outer surface lines of the support rod.

The clamping process is facilitated by providing one of the clamping rods of a clamping rod pair with a through-bore for the clamping screw and the other clamping rod with a threaded bore. The screw head of the clamping screw abuts the first clamping rod on the other side of the through-bore and pulls the first clamping rod in the direction of the second clamping rod when the clamping screw is screwed in the threaded bore.

If the material of the shelf boards is sufficiently strong, each clamping rod may be secured with only one fastening screw. The fastening screw is preferably arranged in the center of the clamping rod section which contacts the shelf board, so that forces and torques acting on the connection between the shelf board and the clamping rod can be reliably transmitted. If a fastening screw were located in an end region of the clamping rod, the thread tends to strip.

The clamping rod can be easily and functionally attached by arranging in the shelf board a through-bore and in the clamping rod a threaded bore into which the fastening screw can be inserted.

Although an arrangement where the shelf boards are clamped in the center with two clamping rods located in the center section of the shelf board edges, does not appear to be very stable, it has been found in practice that the shelf boards can absorb large forces. The support rod is formed of a steel tube with an outer diameter of 40 mm and the clamping rods are formed of a stainless steel profile having a square cross-section with lateral sides having a length of 10 mm. The square profiles are embedded in the shelf boards over a length of 60 mm and the free ends of the steel rods project approximately 45 mm from the plane of the shelf board. The shelf boards of this shelf system can easily carry a weight of 80 kg.

The support rods may be attached in a conventional manner (e.g., fastened with screws to a wall, a floor or the ceiling of a room). Alternatively, an advantageous support system is proposed that is under tension and can be easily installed and modified. For this purpose, the support rod is formed as a threaded spindle and includes a tubular jacket with an interior thread and at least one spindle rod which is screwed into the interior thread of the tubular jacket. Respective support plates are arranged on the free end of the spindle rod and on the opposite free end of the support rod, respectively. The support plates can be biased against the floor and the ceiling of a room. These support rods are formed as expanded spindles and can be installed at the different locations of the room independent of the ceiling height. The shelf system can be adapted to different room heights by using tubular jackets of different length.

In a preferred embodiment of the invention, all elements of the support rods are made of stainless steel. The interior thread is formed by a threaded bushing that is inserted into the tubular jacket. The outer circumference of the threaded bushing includes a radial shoulder which contacts the annual end face of the tubular jacket. A small radial threaded bore may be disposed in the wall of the threaded bushing. A set screw may be screwed into the threaded bore to lock the spindle rod, which is screwed into the threaded bushing, in place.

The end of the spindle rod positioned inside the tubular jacket may be provided with a guide disk which is guided inside the tubular jacket essentially without play. The spindle rod is thereby securely held in place inside the tubular jacket in the radial direction—both in the region of the interior thread and in the region of the guide disk—and can reliably absorb transverse forces or torques.

The support plates of the support rods may be pivotally attached to the ends of the support rods by way of ball and socket joints. This smoothes any unevenness in the ceiling and the floor so that the support rods can be positioned in a true vertical direction.

Additional advantages of the invention are described hereinafter with reference to the drawings. The drawings show in:

DETAILED DESCRIPTION OF PREFERRED EMBODIMENTS

Figure 1:
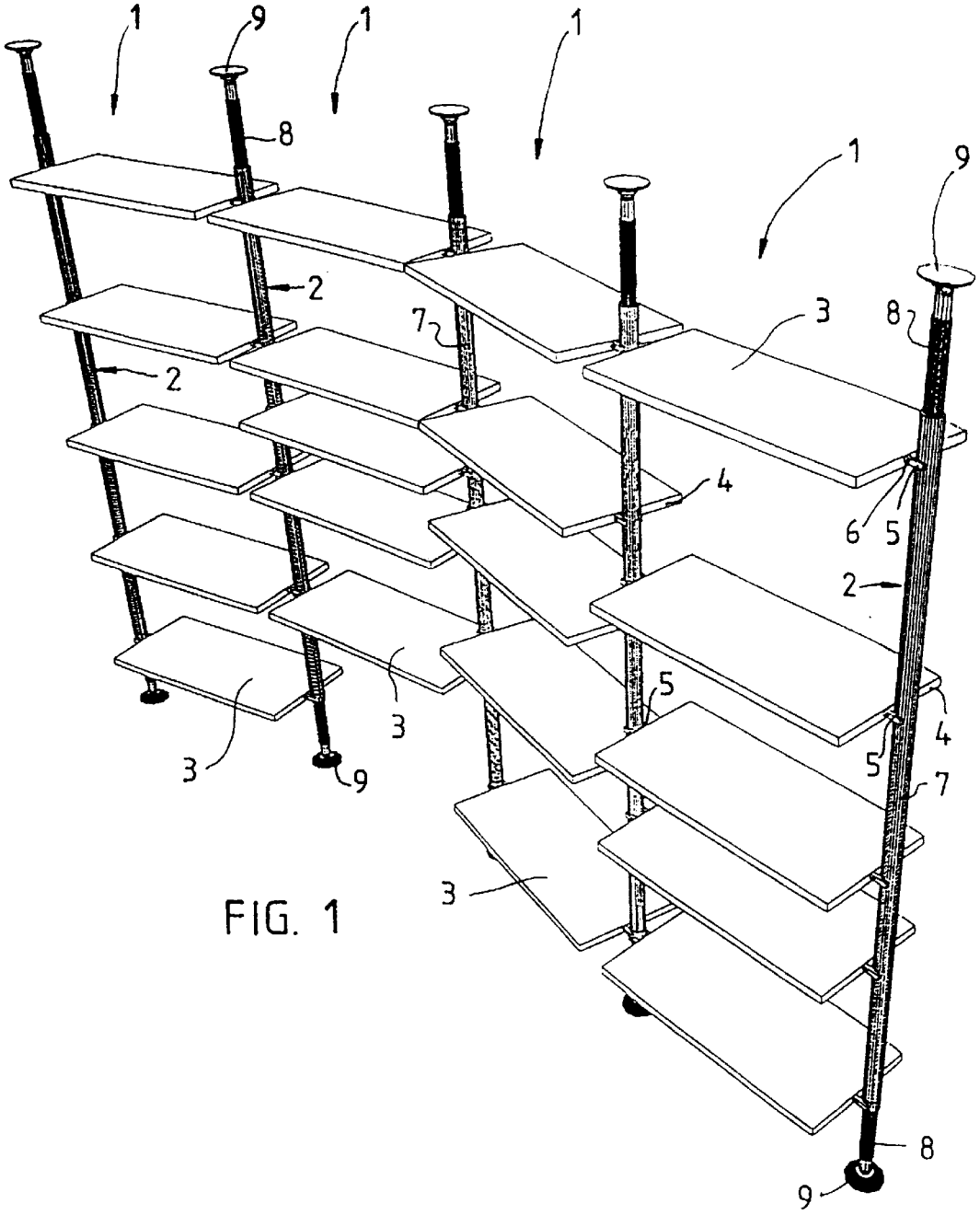
FIG. 1 a schematic illustration of a shelf system according to the invention, FIG. 2 a top view of a shelf board of the shelf system of FIG. 1

The shelf system illustrated in FIG. 1 includes four shelf sections 1, with each side of the shelf sections 1 bounded by a respective support rod 2. Two shelf sections 1 that are arranged side-by-side share a common support rod 2. Each shelf section in the illustrated shelf system includes five shelf boards 3.

The fastening devices which include a pair of parallel clamping rods 5 projecting from the end face, are arranged in the center of the lateral end faces 4. The heads of the clamping screws 6 which clamp the support rods 2 between each clamping pair, contact the outside of the front clamping rods 5.

A major longitudinal portion of the support rods 2 consists of a tubular jacket 7. Each end of the tubular jacket 7 is provided with an interior thread into which a respective spindle rod 8 is screwed. The upper and lower spindle rods are provided with a left-handed thread and with a right-handed thread, respectively, so that the length of the support rod 2 increases when the tubular jacket 7 is turned in one direction, and decreases when the jacket 7 is turned in the other direction. Support plates 9 are secured to the ends of the two spindle rods 8—and thereby also to both ends of the support rod 2—to support the support rod against the floor and the ceiling of a room.

In another embodiment of the support rod 2 described below, only one end of the tubular jacket 7 is provided with a thread; a spindle rod 8 screwed into that thread.

Figure 2:
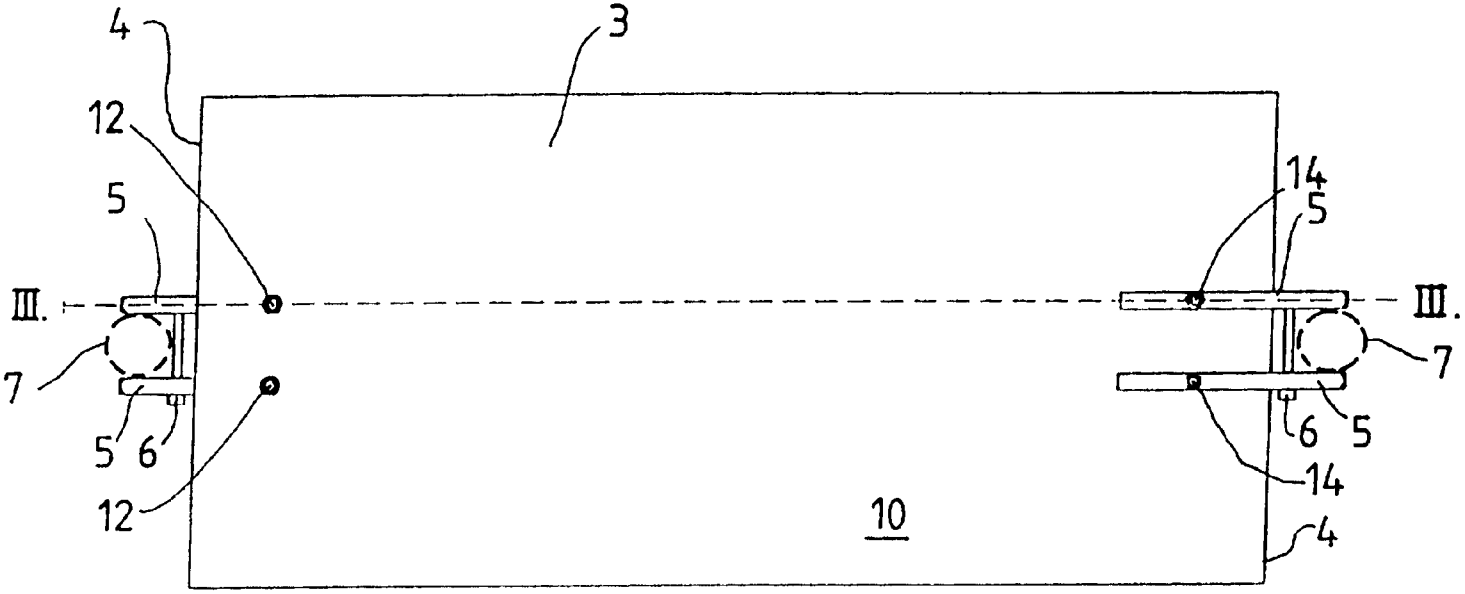
Figure 3:
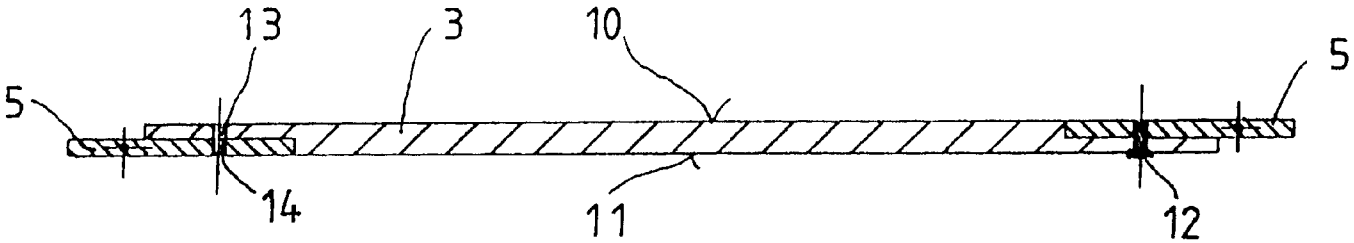
FIG. 3 a cross sectional view of the shelf board of FIG. 2 taken along the line III—III, and FIG. 4 a sectional view of two support rods of the shelf system according to the invention with an interposed shelf board.

The shelf board 3 and the clamping system attached to the shelf board 3 is more clearly illustrated in FIGS. 2 and 3. The clamping rods 5 are inserted into milled grooves which are disposed in the region of the end faces 3 of the shelf board 3 and extend from the end faces in the longitudinal direction. On the right-hand side of FIGS. 2 and 3, the milled grooves are provided in the top surface 10 of the shelf board 3. In the left-hand side of FIGS. 2 and 3, the milled grooves are provided in the bottom surface 11. The depth of the milled grooves corresponds to approximately half the thickness of the shelf board 3. The milled grooves extend from the end faces 4 over a length of 90 mm in the longitudinal direction of the shelf board 3. The fastening screw 12 for the clamping rods is located in the middle of this longitudinal extent. The fastening screw 12 passes through the through-bore 13 of the shelf board 3 and is screwed into a threaded bore 14 of the respective clamping rod 5. The fastening screw 12 has been omitted from the left-hand side of FIG. 3 for sake of clarity.

The clamping screw 6 passes through a through-bore of the clamping rod 5 adjacent to the screw head of the fastening screw 6 and is screwed into a threaded bore of the opposite clamping rod 5.

As can be seen, two shelf boards 3 which are attached side-by-side to the same tubular jacket 7 can be arranged at the same height. The shelf boards are arranged in such a way that the clamping rods of one shelf board 3 are positioned on top of and in contact with the clamping rods 5 of the other shelf board.

To prevent a clamping device from projecting beyond the tubular jacket 7, the clamping screw 6 is arranged between the end face 4 and the tubular jacket 7 of the support rod 2. The length of the free ends of the clamping rods 5 which are disposed on the other side of the clamping screw 6, is equal to approximately three quarter of the diameter of the tubular jacket 7.

Figure 4:
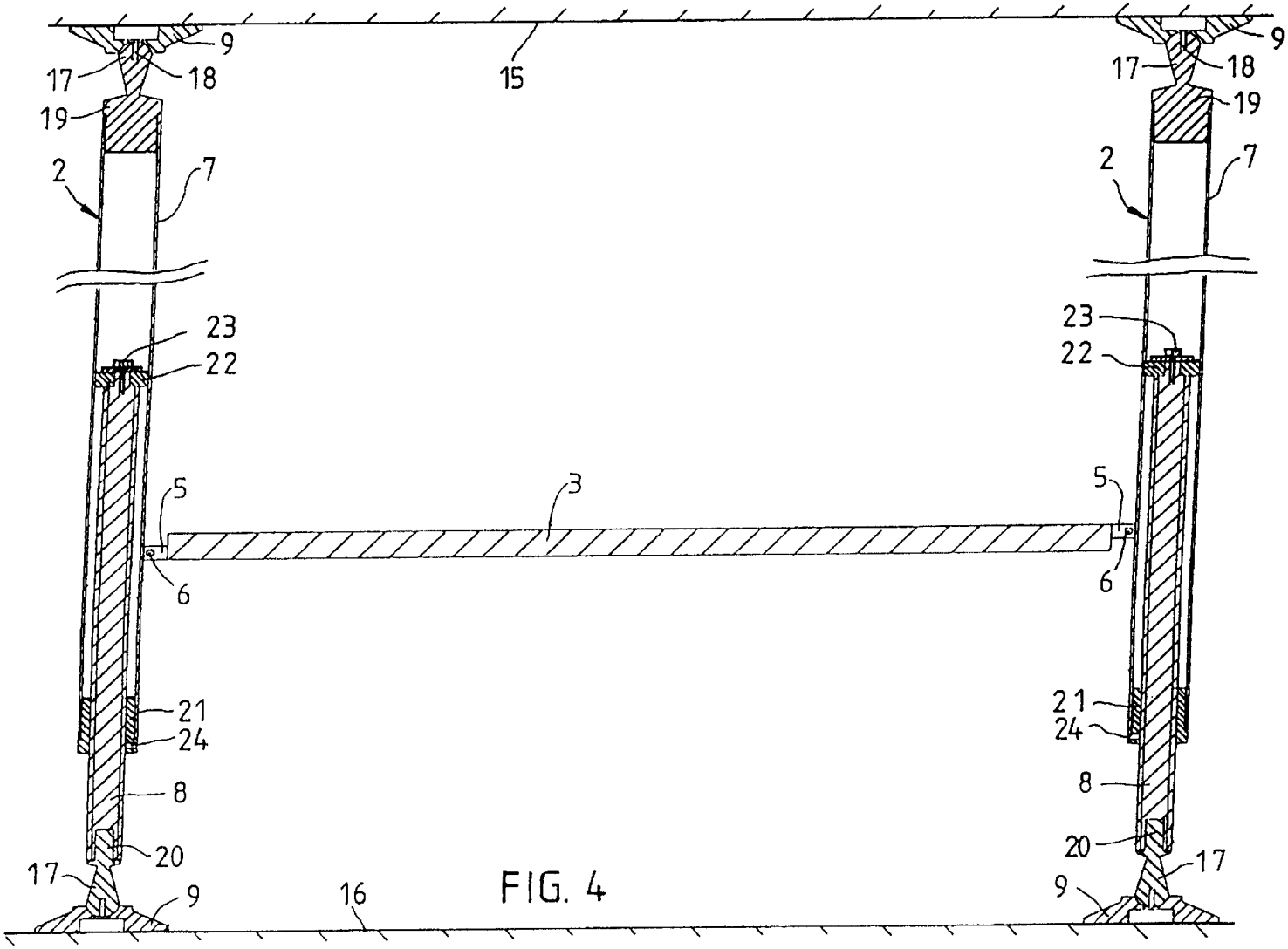

FIG. 4 shows a shelf board 3 supported between two support rods 2. The support rods 2 are pressed against the ceiling 15 and the floor 16 of a room. Support plates 9 are placed against the ceiling 15 and the floor 16, with a ball socket disposed in the center of the support plates 9 and adapted to receive a hemispheric articulated head 17. The articulated heads 17 are provided with a threaded bore 18 adapted to receive a locking screw (not shown). The locking screw secures the support plates 9 to the articulated head 17. The support plates 9 can be rotated in an arbitrary direction about an angle of approximately 10°. The upper articulated heads 17 are connected to a cylindrical insert member 19 which is inserted into an upper end of a tubular jacket 7. The lower articulated heads 17 are connected to a small insert pin 20 which is inserted into the lower end of a spindle rods 8. The upper insert member 19 and the insert pin 20 include a radial shoulder for supporting the tubular jacket 7 and the end face of the spindle rod 8, respectively. Diametrically opposed bores may be provided to secure the insert member 19 in the tubular jacket 7 and the insert pin 20 in the spindle rod 8, respectively. The bores pass through the elements which are connected to each other, and receive the locking pins (not shown).

A threaded bushing 21 is inserted into the lower end of each tubular jacket 7. The threaded bushing 21 can be fixedly secured relative to the tubular jacket 7 with a press fit, with solder, with an adhesive or with a screw. However, the threaded bushing 21 needs not be secured in place, since the clamping force secures the relative position of the components of the support rod after the support rod is installed.

The spindle rod 8 is screwed into the threaded bushing 21. The length of the support rod 2 can be adjusted by rotating the threaded bushing 21 relative to the spindle rod 8. A guide disk 22 is secured on the free end of the spindle rod 8 in the tubular jacket 7 of the support rod 2. The guide disk 22 is locked with a locking screw 23 which is screwed into the central threaded bore of the spindle rod 8. The guide disk 22 which contacts the inside wall of the tubular jacket 7 essentially without play, reliably supports transverse forces and torques which may effect the connection between the tubular jacket 7 and the spindle rod 8.

A small threaded bore 24, which extends in the radial direction, is visible in the lower section of each of the threaded bushings 21. After the support rods 2 are tightened, a set screw can be inserted into the threaded bore 24 which presses against the thread of the spindle rod 8 and holds the support rod 2 in place.

What is claimed is:

1. A shelf system comprising:

a plurality of support rods having a cylindrical cross-section;

a plurality of shelf boards, wherein each shelf board comprises fastening devices for attaching the shelf board to the support rods, each fastening device located near the center of an end face of the shelf board and comprising a pair of mutually parallel clamping rods projecting from the respective end face and connected by a clamping screw;

wherein the clamping rods are pulled towards each other when the clamping screw is tightened, so as to clamp one support rod between each clamping pair, wherein the clamping rods located on opposite end faces of the shelf boards are offset from each other in a direction perpendicular to a major surface of the shelf boards at least by a distance corresponding to a height of the clamping rods in the perpendicular direction.

2. The shelf system of claim 1, wherein each support rod is formed as a threaded spindle and comprises a tubular jacket with an interior thread and at least one spindle rod which is screwed into the interior thread of the tubular jacket, with a first a support plate arranged on a free end of the spindle rod, wherein a second support plate is arranged on the end of the support rod opposite to the free end, so that the support rod can be anchored between a floor and a ceiling of a room using the first and second support plates.

3. The shelf system of claim 2, wherein the interior thread is formed by a threaded bushing inserted in one end of the tubular jacket.

4. The shelf system of claim 3, wherein a threaded bore extends in a radial direction in said threaded bushing and is adapted to receive a set screw for securing the spindle rod and holding the support rod in place.

5. The shelf system of claim 2, wherein a guide disk, which is guided inside the tubular jacket, is secured on the end of the spindle rod positioned inside the tubular jacket, said guide disk contacting an inside wall of the tubular jacket such that there is essentially no radial movement of the guide disk.

6. The shelf system of claim 2, wherein at least one of the support plates that is attached to the ends of support rod can be pivoted via an articulated joint.

7. The shelf system of claim 1, wherein the clamping screw is arranged between a respective end face of the shelf boards and the support rods, and wherein the portion of the clamping rods projecting beyond the clamping screws has a length with is less than a diameter of the support rods.

8. The shelf system of claim 1, wherein the clamping screw passes through a through-bore of a first clamping rod of the clamping rod pair and is screwed into a threaded bore of the second clamping rod of the clamping rod pair.

9. The shelf system of claim 1, wherein the clamping rods have a substantially uniform gap therebetween.

10. A shelf system comprising:

a plurality of support rods having a cylindrical cross-section;

a plurality of shelf boards, wherein each shelf board comprises fastening devices for attaching the shelf board to the support rods, each fastening device located near the center of an end face of the shelf board and comprising a pair of mutually parallel clamping rods projecting from the respective end face and connected by a clamping screw;

wherein the clamping rods are pulled towards each other when the clamping screw is tightened, so as to clamp one support rod between each clamping pair, wherein each clamping rod is secured to the shelf board with a fastening screw, and wherein a distance between an end of the clamping rod located in the plane of the shelf board and fastening screw is essentially identical to a distance between the fastening screw and the end face of the shelf board.

11. The shelf system of claim 10, wherein the fastening screw passes through a through-bore located in the shelf board and is screwed into a threaded bore of the clamping rod.

12. A shelf board comprising:

a plurality of fastening devices for attaching the shelf board to a support rod, each fastening device located near the center of an end face of the shelf board and comprising a pair of mutually parallel clamping rods projecting from the respective end face and connected by a clamping screw;

wherein the clamping rods are pulled towards each other when the clamping screw is tightened so as to clamp one support rod between each clamping pair, wherein the clamping rods which are located on opposite end faces of the shelf board are offset from each other in a direction perpendicular to a major surface of the shelf board by a distance corresponding to a height of the clamping rods in the perpendicular direction.

13. The shelf system of claim 12, wherein the clamping rod comprises an essentially planar gripping surface facing the support rod.

14. The shelf system of claim 12, wherein the clamping rod has an essentially rectangular cross-section.

15. The shelf system of claim 12, wherein the clamping rod has an essentially square cross-section.

16. The shelf system of claim 12, wherein the clamping rod is made of stainless steel.

17. The shelf system of claim 12, wherein the clamping rod is embedded in the shelf board.

18. A shelf board comprising:

a plurality of fastening devices for attaching the shelf board to a support rod, each fastening device located near the center of an end face of the shelf board and comprising a pair of mutually parallel clamping rods projecting from the respective end face and connected by a clamping screw;

wherein the clamping rods are pulled towards each other when the clamping screw is tightened so as to clamp one support rod between each clamping pair;

wherein the clamping rod is secured to the shelf board at a location which is located halfway between an end of the clamping rod located in the plane of the shelf board and the end face of the shelf board, wherein the clamping rod is secured to the shelf board with a fastening screw which passes through a hole in the shelf board into a threaded bore of the clamping rod.

* * * * *